United States Patent [19]

Johnson

[11] 4,215,639

[45] Aug. 5, 1980

[54] SELECTIVELY CONTROLLABLE BOBBIN THREAD PULL-OFF MECHANISM

[75] Inventor: Ralph E. Johnson, Convent Station, N.J.

[73] Assignee: The Singer Company, Stamford, Conn.

[21] Appl. No.: 9,021

[22] Filed: Feb. 2, 1979

[51] Int. Cl.[2] ..... D05B 27/22; D05B 27/02

[52] U.S. Cl. ..... 112/242; 112/323

[58] Field of Search ..... 112/184, 191, 242, 246, 112/243, 323

[56] References Cited

U.S. PATENT DOCUMENTS

| | | | |
|---|---|---|---|
| 715,911 | 12/1902 | Warren | 112/58 |
| 909,839 | 1/1909 | Woodward | 112/242 |
| 1,105,968 | 8/1914 | Diehl et al. | 112/242 |
| 1,792,237 | 2/1931 | Parkes | 112/184 |
| 2,438,833 | 3/1948 | Wood | 112/242 |
| 3,164,113 | 1/1965 | Ketterer | 112/242 |
| 3,467,039 | 9/1969 | Greenwood, Jr. et al. | 112/242 X |
| 4,091,753 | 5/1978 | Johnson et al. | 112/184 |

FOREIGN PATENT DOCUMENTS

| | | |
|---|---|---|
| 53-79647 | 7/1978 | Japan . |
| 382424 | 10/1931 | United Kingdom . |

*Primary Examiner*—Wm. Carter Reynolds

*Attorney, Agent, or Firm*—William V. Ebs; Robert E. Smith; Edward L. Bell

[57] ABSTRACT

A lock stitch sewing machine is provided with mechanism controllable by a servo motor for pulling thread from a bobbin, and including a selectively positionable member operably connected with a feed dog and bobbin thread engageable means for causing thread to be pulled from the bobbin by the thread engageable means during downward motion of the feed dog in amounts determined by the position of the selectively positionable member.

4 Claims, 4 Drawing Figures

SELECTIVELY CONTROLLABLE BOBBIN THREAD PULL-OFF MECHANISM

BACKGROUND OF THE INVENTION

1. Field of the Invention

The invention relates to thread handling devices for use in a sewing machine, and more particularly to mechanism for pulling thread from a bobbin spool in a lock stitch sewing machine.

2. Description of the Prior Art

It is known to provide a lock stitch sewing machine with means for pulling thread from a bobbin spool for use in the formation of stitches, and it is usual for such thread pulling means to supply a constant amount of thread for each stitch regardless of the material being sewn, the length of stitch called for, or the type of stitch being formed. However, the feeding of constant amounts of bobbin thread regardless of sewing conditions is a disadvantage in that it may result in stitches (straight or zigzag) which are drawn too tight and cause puckering of material being sewn, or in stitches which are inadequately locked and may therefore easily pull out of the material.

SUMMARY OF THE INVENTION

In accordance with the invention, a lock stitch sewing machine is provided with mechanism which may be controlled as by a servo motor, and caused in response to an input signal to the servo motor to pull a predetermined quantity of thread from a bobbin for use in the formation of stitches. Such mechanism includes a fixed thread support between a bobbin spool and needle, movable thread engageable means cooperable with the fixed support for pulling thread from the bobbin, a feed dog, and a selectively positionable member operably connected with the feed dog and said thread engageable means for causing the thread engageable means to pull thread from the bobbin in an amount determined by the position of the selectively positionable member.

DETAILED DESCRIPTION OF THE INVENTION

Figure 1:
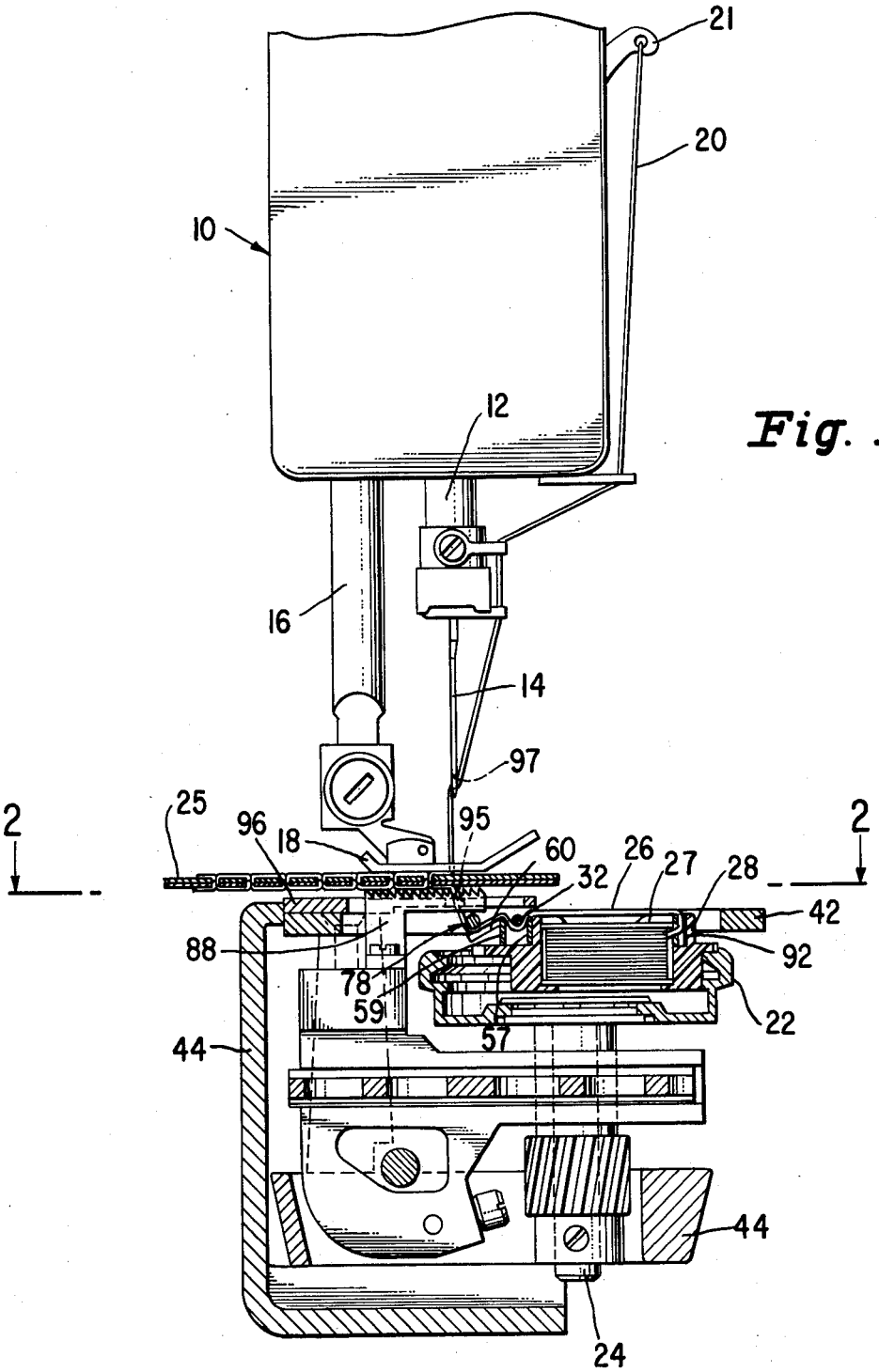
FIG. 1 is a fragmentary end elevational view partially in section of a sewing machine including the bobbin thread pull-off mechanism of the invention.

Referring to the drawings, reference character 10 designates the head end of a lock stitch sewing machine wherein a needle bar 12 is vertically reciprocable. A sewing needle 14 is affixed in the needle bar 12 for reciprocation thereby. As shown, the head end 10 of the sewing machine carries a presser bar 16, and the presser bar carries a foot 18 which is used to hold down work as it is sewn with the needle 14.

Thread 20 is supplied from a spool (not shown), through a tension device (not shown) and a take-up 21 to the needle 14 for use in forming stitches. A loop taker 22 which is rotatable by a shaft 24 cooperates in a known manner with the needle 14 to cause lock stitches to be formed in material 25 with the needle thread 20 and thread 26 supplied from a bobbin spool 27 rotatably mounted in a stationary bobbin case 28. A detailed description of the manner in which such loop taker cooperates with a needle from lock stitches may be found, for example, in U.S. Pat. No. 2,862,468 of R. E. Johnson, for "Ornamental Stitch Sewing Machines" issued Dec. 2, 1958, and assigned to The Singer Company.

In accordance with the invention, a thread pulling bar 30 including a bobbin thread engageable leg 32 is provided to pull thread from the bobbin spool 27. Such thread pulling bar is pivotable on pin formations 34 and 36 which extend into recesses 38 and 40 respectively provided in a bed plate 42 that is secured to a stationary frame 44 at 46, 48 and 50. Screws 52 and 54 secure washers 56 and 58 to the bed plate 42 in positions overlapping the recesses 38 and 40 to prevent dislogement of the thread pulling bar from the bed plate. As shown, leg 32 of the thread pulling bar extends between spaced walls 57 and 59 provided on the bobbin case 28.

Thread pulling bar 30 includes as an integral part thereof a downwardly projecting angular extension 60 which is engageable by the end portion 62 of a selectively positionable member 64. Member 64 is formed with a right angled slide bar 66 and a right angled bifurcated extension 68 having parallel arms 70 and 72 that define a channel 74. Bar 66 is slidable in a right angled cylindrical portion 76 of a member 78 which is pivotally mounted in recesses 80 and 81 in bed plate 42. The member 78 extends between arms 70 and 72 of extension 68 on member 64 and is engageable at 84 and 86 by feed dog 88 which serves in the usual manner to move material being sewn in either a forward or reverse feeding direction when the needle is out of the work such that successive stitches may be formed. It is to be understood that the feed dog is moved, as usual, along a more or less elliptical path by suitable feed dog actuating mechanism which as shown is of the type illustrated and described in the U.S. Pat. application Ser. No. 971,961 of Ralph E. Johnson for "Feed and Loop Taker Module for a Sewing Machine", filed December 1978, and assigned to The Singer Company.

In preparation for sewing, the bobbin case is threaded by drawing the thread 26 from the bobbin spool 27 through a slit 90 in the case 28 and under a tension spring 92 and thence through a notch 94 in the case. Beyond the notch 94, bobbin thread 26 is passed over bobbin case wall 57, under leg 32 of the thread pulling bar, and over bobbin case wall 59, after which the thread is passed under member 78 and up through an opening 95 in a throat plate 96. Thread 20, after passing through a conventional thread tensioning device and take-up arm 21, is threaded through the eye 97 of needle 14.

The needle 14, loop taker 22 and feed dog 88 operate in timed relationship during sewing operations, and lock stitches are formed in the usual manner, all as described in U.S. Pat. No. 2,862,468 (mentioned hereinbefore), except that bobbin thread is supplied for such stitches in accordance with the invention. Thread is pulled for the stitches from bobbin spool 27 in successive increments of a length predetermined by the setting of selectively positionable member 64 which is under the control of a linearly movable slide 98 positionable in recesses 100, 102 and 104 in bed plate 42 and is connected with the slide through a pin 106 on the slide and an elongated slot 108 formed in the member 64.

When the feed dog 88 completes a work feeding movement in either forward or reverse feed, the bobbin thread 26 is taut and acts upwardly against member 78 causing the member to be held against feed dog 88 at 84 and 86. The bobbin thread also acts upwardly against leg 32 of pivoted member 30, and leg 32 is thereby held at the level of the top of walls 57 and 59. When the feed dog moves downwardly beyond a work feeding position, it causes the member 78 to be pivoted downwardly about its pivotal axis 110. Member 64 is moved downwardly by member 78, and the member 64 comes in contact with angular extension 60 on the thread pulling bar 30 causing the bar to be pivoted downwardly about its pivotal axis 112 to result in thread 26 being pulled from bobbin spool 27 into the space between walls 57 and 59 by the leg 32 where it is temporarily stored out of the way of the loop taker until used during the formation of a stitch.

Beyond its lowest position, the feed dog 88 is moved in a direction opposite to the work feeding direction and then upwardly after which it resumes movement in the work feeding direction. As the feed dog moves upwardly and during movement in the work feeding direction, a stitch is set in the usual manner by the operation by the needle thread takeup 21, and the loose bobbin thread 26 is drawn from between the walls 57 and 59 by the pull of a loop of needle thread on the bobbin thread. The bobbin thread which becomes taut pivots the thread pulling bar 30 upwardly and thereby repositions leg 32 enabling it to once again to pull thread from the bobbin spool 27 when the feed dog moves downwardly.

Figure 3:
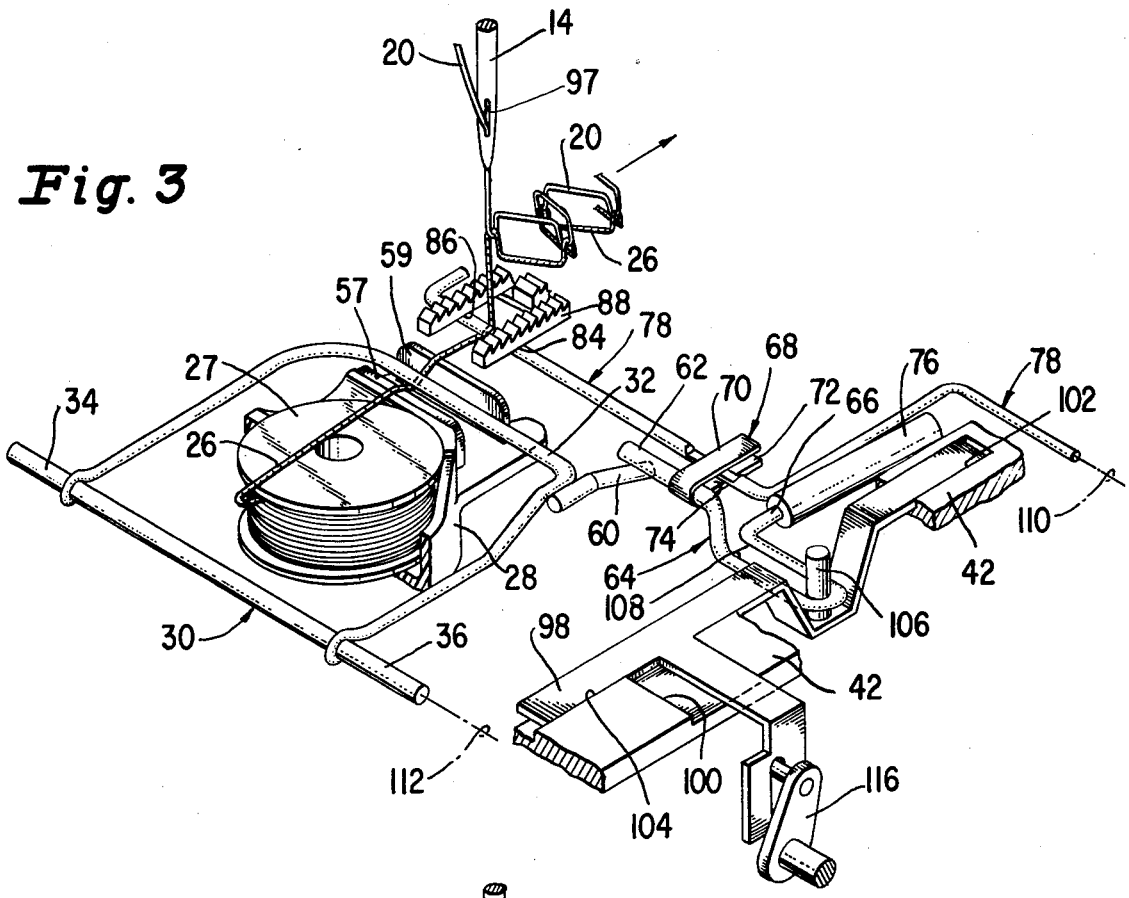
FIGS. 3 and 4 are perspective somewhat schematic views illustrating the operation of the mechanism of the invention for providing bobbin thread for short and long stitches respectively.
Figure 4:
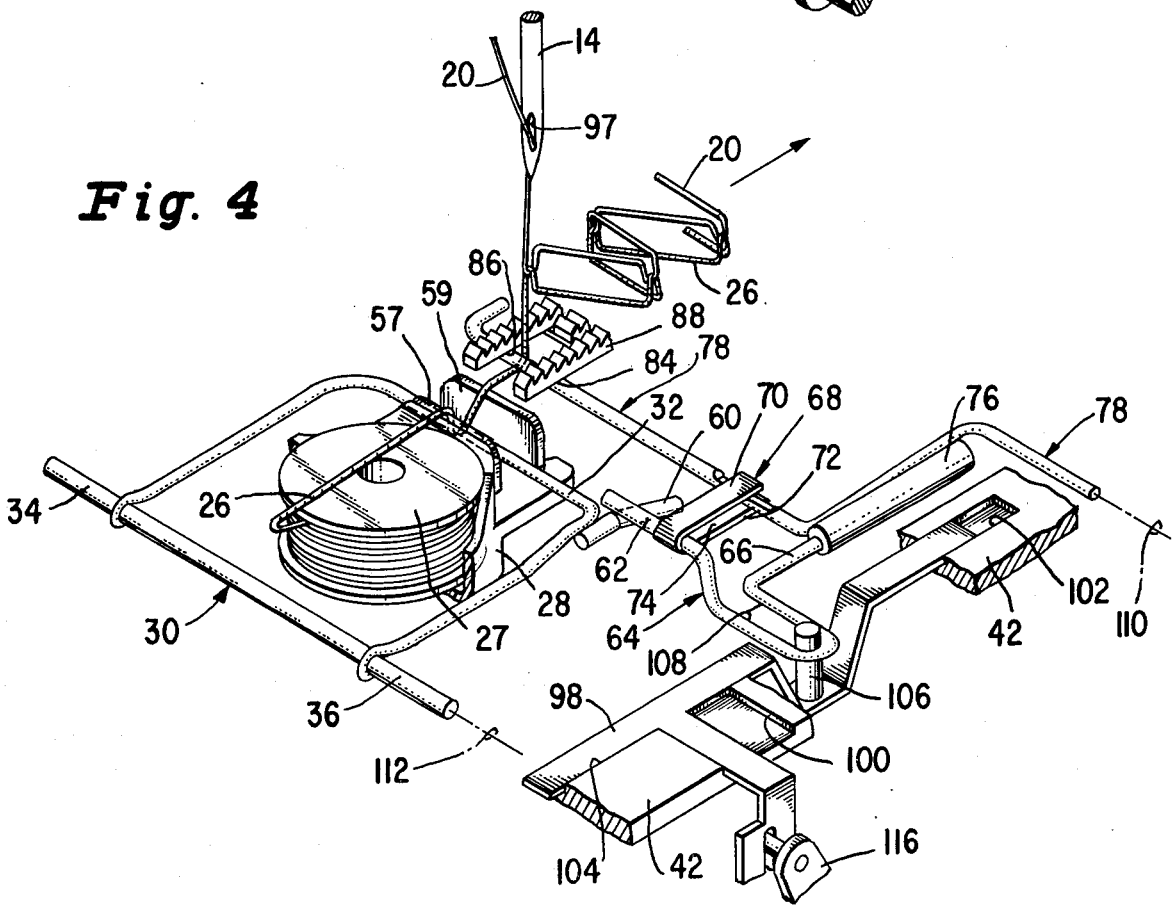

As noted hereinbefore, selectively positionable member 64 is under the control of slide 94. Such slide is used to position member 64 relative to angular extension 60 of member 30, and when positioned so as to cause member 64 to contact the lower end of extension 60 during downward movement of the feed dog, a minimum length of thread is pulled from bobbin spool 27 by leg 32 of bar 30 (FIG. 3). When the slide is positioned to cause member 64 to contact extension 60 at a higher location during downward movement of the feed dog, a longer length of thread is pulled from bobbin spool 27 by leg 32 (FIG. 4).

Figure 2:
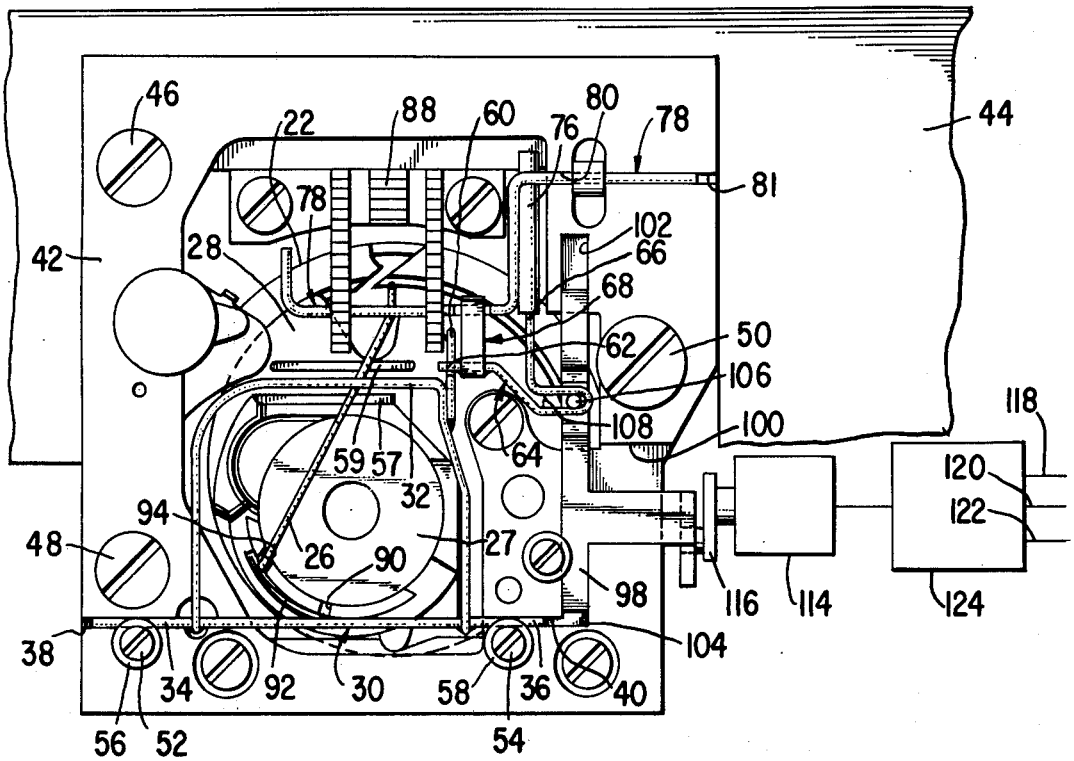
FIG. 2 is a top plan view taken on the plane of the line 2—2 of FIG. 1.

Slide 94 may be controlled, as shown in FIG. 2, by a servo motor 114 acting through a link 116 in response to input signals fed over lines 118, 120 and 122 to a signal amplifier and processor 124 which is shown connected to the servo motor; and with signals generated in the lines 118, 120 and 122 by potentiometers or any other suitable means representing a selected stitch length, a presser bar position and needle bight, the thread pulling bar 30 may be caused to draw lengths of thread for perfect stitches from bobbin spool 27 regardless of the thickness of material being sewn or the length of stitch called for, and whether or not straight or zig-zag stitches are being formed.

It is to be understood that the present disclosure relates to a preferred embodiment of the invention which is for purposes of illustration only, and that various modifications may be made therein without departing from the spirit and scope of the invention as defined in the appended claims.

I claim:

1. In a lock stitch sewing machine, mechanism for removing predetermined lengths of thread from a bobbin spool for use in the formation of stitches by a needle including fixed spaced walls between the bobbin spool and needle, a pivoted thread pulling bar having a leg movable between said walls for pulling thread looped under the leg and over said walls from the bobbin spool and into the space between the walls during pivotal movement of the thread pulling bar in one direction, a feed dog, a selectively positionable member, and means for controlling the extent of movement of the thread pulling bar in accordance with the position of the selectively positionable member and thereby the amount of thread removed from the bobbin spool by the bar, said means including a member actuable by the feed dog and in sliding engagement with the selectively positionable member for imparting movement to the selectively positionable member, the said means also including an angular extension on the thread pulling bar engageable by the selectively positionable member at a location dependent upon the selected position thereof.

2. The combination of claim 1 including a linearly movable slide operably connected to the selectively positionable member for disposing the selectively positionable member in a selected position with respect to the said angular extension on the thread pulling bar.

3. The combination of claim 2 wherein said selectively positionable member and slide are pin connected in a slot permitting the selectively positionable member to move in a direction different from the linear direction of movement of the slide.

4. The combination of claim 3 including a servo motor operably connected to the slide for positioning the slide and thereby the selectively positionable member.

* * * * *